United States Patent [19]

Wood

[11] 4,151,969

[45] May 1, 1979

[54] SYSTEM FOR SELECTIVELY DETERMINING THE LOCATION OF A RAILWAY CAR MOVING ALONG A RAILWAY TRACK

[75] Inventor: Robert E. Wood, Tucker, Ga.

[73] Assignee: Southern Railway Company, Washington, D.C.

[21] Appl. No.: 832,617

[22] Filed: Sep. 12, 1977

[51] Int. Cl.[2] ..... B61L 25/02; B61L 29/32

[52] U.S. Cl. ..... 246/122 R; 246/128; 246/182 A

[58] Field of Search ..... 73/597, 628; 104/26; 246/30, 122 R, 125, 128, 130, 167 R, 167 D, 182 R, 182 A, 182 BH, 182 C, 187 C; 324/83 D, 171

[56] References Cited

U.S. PATENT DOCUMENTS

| | | | |
|---|---|---|---|
| 3,305,682 | 2/1967 | Bolster et al. | 246/187 C |
| 3,342,989 | 9/1967 | Dwyer et al. | 246/122 R |
| 3,564,488 | 2/1971 | Higashi et al. | 73/628 X |
| 3,619,604 | 11/1971 | Auer, Jr. et al. | 246/125 X |
| 3,781,543 | 12/1973 | Staples et al. | 246/130 |

*Primary Examiner*—Stephen G. Kunin

*Attorney, Agent, or Firm*—Watson, Cole, Grindle & Watson

[57] ABSTRACT

The velocity of a railway car travelling along a particular track can be determined by measuring the distance travelled by the car during a predetermined time interval. This distance travelled is measured by determining the location of the car with respect to a fixed point on the track at two different points of time. The determination of the location, in turn, is found by measuring the time period that it takes an electric signal applied at a fixed signal generating point to travel along the railway track and, once reaching the car, to be reflected back along the track to the signal generating point. By measuring the time delay between the applied signal and the reflected signal, the distance between the application point and the closest railway car on the track can be measured.

13 Claims, 8 Drawing Figures

SYSTEM FOR SELECTIVELY DETERMINING THE LOCATION OF A RAILWAY CAR MOVING ALONG A RAILWAY TRACK

BACKGROUND OF THE INVENTION

The present invention relates to a system for measuring the velocity of a car moving along a railway track by determining the location of the car along the railway track at two different points of time.

In the operation of today's modern classification yards, the speed of the cuts (i.e., a single car or group of cars travelling through the classification yard) directed to each of the particular storage tracks is controlled so that the cut when arriving at the storage track is travelling at a predetermined speed. That speed, herein called the entering velocity, is dependent upon, inter alia, the distance that the cut must travel in order to couple with the previous cut that entered the particular storage track. If a particular storage track has very few cars on it (presuming that all of the cars on the track are coupled together), it is necessary for the next cut entering that particular storage track to travel a relatively great distance and hence the cut when entering that storage track should be travelling at a greater entering velocity than would be desirable if the track was filled with more cars. Conversely, if the track is almost full, then the entering speed of the cut should be less so as to minimize the impact force against the last car already in the particular storage track. As is well known, the speed of the cuts can be controlled by the operation of the retarders in the classification yard.

The exit speed that the cut should have when it leaves the retarder, therefore, is dependent upon the distance from the retarder to the point of coupling in the storage track to which the cut is assigned. For proper coupling to occur, the car must be moving with sufficient momentum both to reach the last car of the previous cut and to close the coupling mechanism. In order to have such momentum the cut should generally be travelling at about 3 miles per hour upon impact. While this is the ideal coupling velocity, unfortunately several factors cause variations in the speed of the cuts. Such variations in the speed can lead either to damage to the cars of their lading if the cuts are travelling too fast or to failure of coupling if the cuts are travelling too slow.

The variations in speed can result from a plurality of different factors, in addition to the distance the cut must travel, such as the condition of the tracks or the forces of a strong wind. With respect to the condition of the tracks, this becomes especially significant where the classification yard is built upon a swamp, since the moisture and soft soil will affect the contour of the track. Attempts are often made to compensate for such variations by manually determining the deviation between the actual speed of a cut travelling along a particular storage track and the ideal speed for such cut. Upon determining the deviation, the information for controlling the retarder can be modified so as to compensate for the speed variations.

In order to determine the distance that a cut has to travel within a particular storage track before coupling, a measurement is made of the distance between the initial point of the storage track and the last car within that track. This measurement is often referred to as the DTC, i.e. the distance to coupling. In previously known systems, this measurement has been made through the use of either a radar system or through an impedance measuring system.

Two radar systems which are utilized for this purpose are shown by U.S. Pat. No. 3,377,587 to Nakahara et al. and U.S. Pat. No. 3,463,919 to DaRold et al. In the first of these two patents, the distance between two cars travelling along the same track is measured by the transmission of a radar signal along a specially built microwave waveguide positioned between the tracks. The signal is transmitted by one car towards the other car. The signal is then reflected by the second car back towards the generating point. The time between generation and receipt back of the radar signal provides an indication of the distance between the two moving vehicles. In the latter of the two patents, the same principle is utilized, but the radar signal is transmitted above ground without the use of any special conduits.

Radar system relying upon microwave waveguides are both extremely expensive and relatively complex both in setting up and in operation. In order to properly operate the radar system where the microwaves are transmitted along a waveguide, it is mandatory that the waveguides be properly aligned. While the alignment process has been relatively well developed, it is still a complex procedure, especially when the waveguides must be laid over great distances, as would be the case in a railway classification yard. Furthermore, the waveguides must remain in alignment. In all probability, the vibration caused by the rolling cuts along the track would tend to knock the waveguides out of alignment thereby rendering the system useless.

When a radar system is utilized where the microwaves are transmitted above the tracks, other problems occur. Such microwaves are generally transmitted through the use of a dish transmitter. Since the collimation of the beam is related to the size of the dish, in order to have relatively good resolution, the diameter of the dish must be fairly large. Of course, the larger the dish the larger the expense and the more impractical the system becomes. Furthermore, it is possible for the radar beams to bounce off other cars at adjacent locations if such cars are closer to the signal generating point. When this occurs, the system provides a measurement based on improper information.

Examples of the second type of system, an impedance measuring system, are shown in U.S. Pat. No. 3,342,989 to Dwyer et al., U.S. Pat. No. 3,619,604 to Auer et al. and U.S. Pat. No. 3,781,543 to Staples et al. In the system disclosed by each of these patents, a measurement is made of the attenuation in a signal which is transmitted along one rail of a particular track and reflected back along the other rail of that track. As shown by the patent to Auer et al., the signal is transferred from the first rail to the second rail by a shunt formed by a set of wheels and axle of a car located on the track. The attenuation of the signal is dependent upon the length of the rail along which the signal has travelled since the length of the rail varies the impedance of the current loop. Thus the longer the rail the greater the attenuation. The attenuation measurement, therefore, provides an indication of the distance that the signal has travelled which is indicative of the location of the car shunting the signal between the first and second rails of the particular track. The systems disclosed in the patents to Dwyer et al. and Staples et al. also rely upon impedance measurements. In the systems disclosed by both of these latter patents, multiplexers are provided so that the measurement system can be utilized for determining the location of the last car in each of a plurality of tracks.

In the impedance type measuring system such as shown in the above-noted patents, a current loop is formed between the measuring system, the railway track under consideration and the last car within the track. Since the resistance in the loop will depend upon the length of the track, the voltage varies with he length of the track. Prior to measuring the attenuation, however, it is necessary for all transients in the applied signal to die away so that a constant signal is transmitted along the tracks. Since the impedance measuring system requires a constant signal, there can be a delay of several seconds between the initial application of the signal and the time when a measurement can be made. Due to this delay, the amount of information, i.e., the number of tracks which can be tested within a set time, is significantly limited. Furthermore, such attenuation systems generally give a resolution only accurate to four car lengths. Since the retarder exit speeds of the cuts are dependent upon the measurement made by the system, it is obviously desirable to have the best resolution possible and often the poor resolution provided by an impedance measuring system can lead to either hard couplings and possible damage to the cars or stalling of the cars during the operation of the system.

More important than the problems exhibited by the radar and impedance measuring systems in rendering static measurements of the distance to coupling, it is extremely difficult with such systems to make any dynamic measurements relating to the movement of the car along the storage track. Due to the relatively poor resolution of such systems, if successive measurements are made at short time intervals, a forward moving car could appear to be either backing up or standing still. Consequently, in order to measure the speed of the cut moving along the storage track and hence coupling speed, there must be a significant time interval between each measurement of the location of the cut. The length of the time interval limits the number of speed measurements that can be made, which then means that it must be assumed that the deceleration of the cut as it travels along the storage track is constant. The coupling velocitys and decelerations of the cuts are used to control the retarder so as to minimize the deviations between the actual and ideal velocities.

The deceleration of the cut as it travels over the storage track, however, can vary due to several different reasons, such as tight gauge of the track, soft spots in the track bed and variations in the contour of the track. Such variations affect the dynamic characteristics of the cut as it travels along the storage track. Without being able to make a large number of speed measurements, it is impossible to accurately and automatically calibrate the system so as to minimize the speed deviations.

SUMMARY OF THE INVENTION

An object of the present invention is to provide an improved system for obtaining a plurality of accurate velocity measurements of a cut moving along a railway track.

Another object of the present invention is to provide an improved system for measuring the distance to coupling for each of the storage tracks in a railway classification yard.

Still another object of the present invention is to provide a system for measuring the distance to coupling for each of the storage tracks in a railway classification yard which overcomes the disadvantages of the radar type measuring system and impedence type measuring system previously utilized in the prior art as discussed above.

Still a further object of the present invention is to provide a system for measuring the distance to coupling for each of the storage tracks in a railway classification yard which system can be incorporated within the yard with a relatively minimal expenditure and yet provide a highly accurate resolution.

Still another object of the present invention is to provide a system for accurately measuring the coupling speed of a car in a storage track.

Still a further object of the present invention is to provide a system for providing the dynamic characteristics of a car moving along a track.

These objectives are achieved through the employment of the car location measuring system according to the present invention. In accordance with this system, a series of signals is transmitted to each of the tracks on which a measurement is to be made. The signal is coupled to one of the two rails of the track under investigation. The signal travels along that first rail until it reaches the rear wheels and axle of the last car within the particular track. The rear wheels and axle of the car act as a shunt electrically interconnecting the two rails of the track. The signal is transferred by the shunt connection to the second rail of the track and then travels back along the second rail towards the origination point. Measuring circuits are connected to receive both the signal applied to the first rail and the signal reflected back along the second rail. By determining the time delay between the two signals, an output signal which is indicative of the distance between the point at which the signal was applied to the first rail and the location of the last car in the track is obtained.

Although other applications are possible, the two primary applications for the measuring system of the present invention is in a railway classification yard for measuring the distance that each cut entering a storage track must travel in order to couple with the last car in that track and for measuring the coupling velocity of the cut. By determining the location of the last car on the storage track with respect to the entry point of the storage track, the distance to coupling for the track is known and the measurement can be utilized for controlling the operation of the retarders on the cuts directed towards a particular track. Thus, the closer the last car is to the entry point of the track, the less distance a cut will have to travel and hence the retarder will provide a slower exit speed. Alternatively, if a greater distance is measured, then the speed of the cut must be greater so that it travels the full length of the storage track and still impacts with sufficient force for causing coupling of the cars. Further, by obtaining an accurate measurement of the actual coupling velocity, the retarders can be appropriately controlled so as to minimize the deviation between the actual and ideal coupling velocities. This later procedure can be referred to as tuning the system.

Since the system of the present invention relies upon the time delay between the signal applied and the reflected signal received and not upon the attenuation of the signal, in contrast to the impedance measuring system, there is no need to wait for the transients in the signals to die out. Thus, the measurements can be made based upon the leading edges of the signals. For this reason, measurements can be made much more rapidly and with greater resolution. The resolution of the system of the present invention would be approximately one quarter of carlength. Due to the increased speed at which the measurements can be made and the improved resolution, a plurality of distance measurements can be made as the cut travels along the storage track. By calculating the distance travelled during each time interval, the velocity of the cut can also be determined.

The signals which are applied to the track in accordance with the present invention travel along the track at approximately the speed of light ($3\times10^8$m/s). Thus, if a car length is 15 meters long, the elapsed time for a signal to travel one car length is:

$$(2\times15\text{m})/(3\times10^8\text{m/s})=100 \text{ nanoseconds}$$

For a car which is located approximately 50 car lengths from the entrance of a particular storage track, the elapsed time, or time delay, would be five microseconds.

The advantage of the high-speed, high resolution measurement associated with the system of the present invention is that it allows accurate measurement of the location of the car at a plurality of points of time while the car is moving along the track. The computer utilized in controlling the classification yard can store and utilize this data for a plurality of cars that recently entered a particular storage track so as to obtain the average deceleration of the cars as a function of where the car is on the track. The deceleration is obtained by differentiating the speeds that are calculated with respect to the time. Using this technique and curve fitting routines, precise coupling speeds can be obtained so that the recent history of the performance of each cut, at each location within the track, is available for tuning the computer program. The actual calculations are done by the computer itself. In contrast to such an automatic tuning, in the classification yard today, successful tuning is done manually and is an extremely laborious project, especially at a yard with a fluid subgrade, i.e. a yard built on a swamp. Changes in soil moisture or temperature radically alter the condition of the track and hence make correct tuning of the system extremely difficult.

The ultimate advantage of the proposed system is that it allows continuous computer controlled tuning of the retarder control software, hence a narrowing of the statistical standard deviation in coupling speeds. This allows for more accurate coupling speed thereby decreasing the number of stalls and accidents. In turn, this means few freight damage claims and high yard efficiency.

BRIEF DESCRIPTION OF THE DRAWINGS

FIGS. 2(*a*) to 2(*g*) show the signals at a plurality of different points in the measuring system illustrated in FIG. 1.

DESCRIPTION OF THE PREFERRED EMBODIMENT

Figure 1:
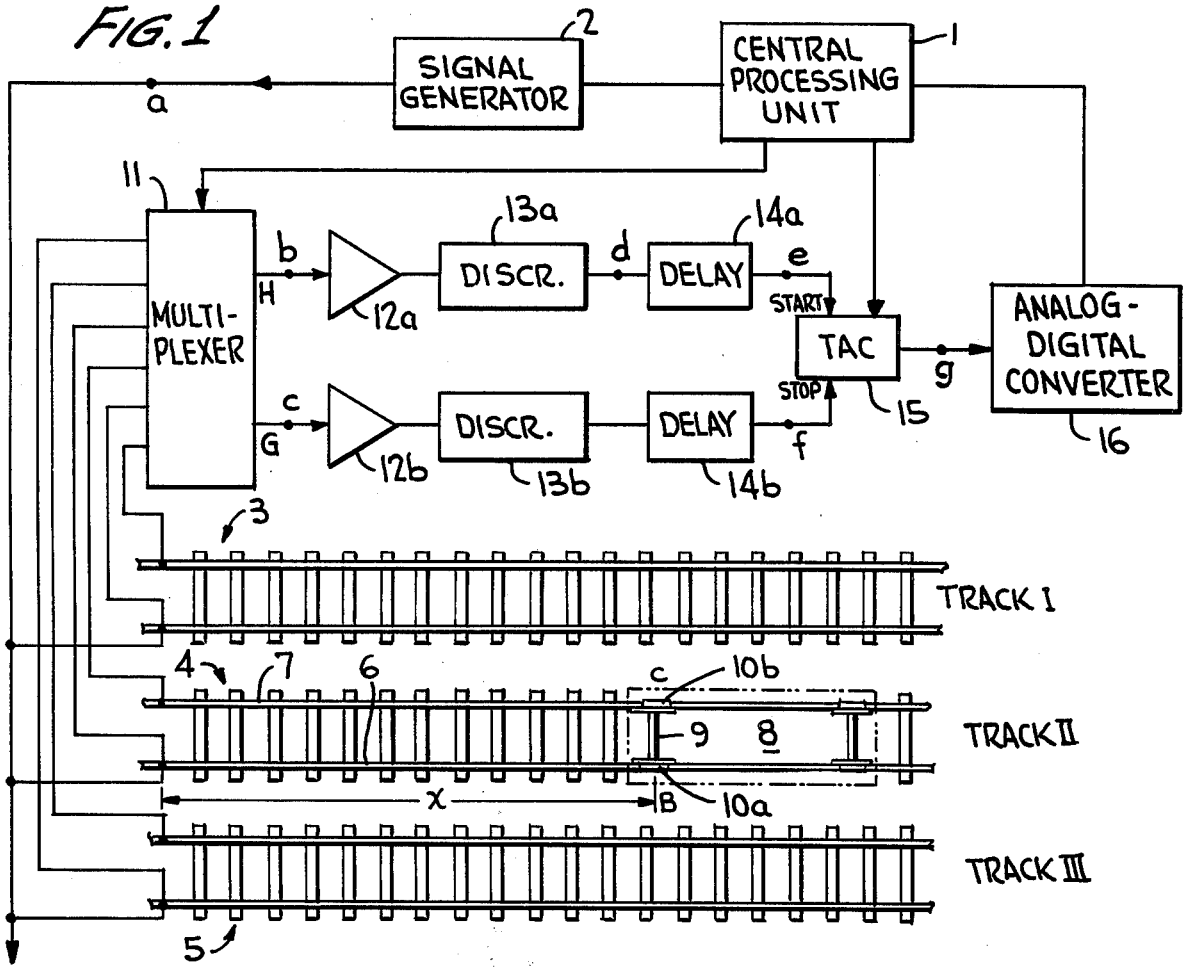
FIG. 1 is a block-circuit diagram of the measuring system of the present invention when utilized in connection with a railway classification yard.
Figure 1:
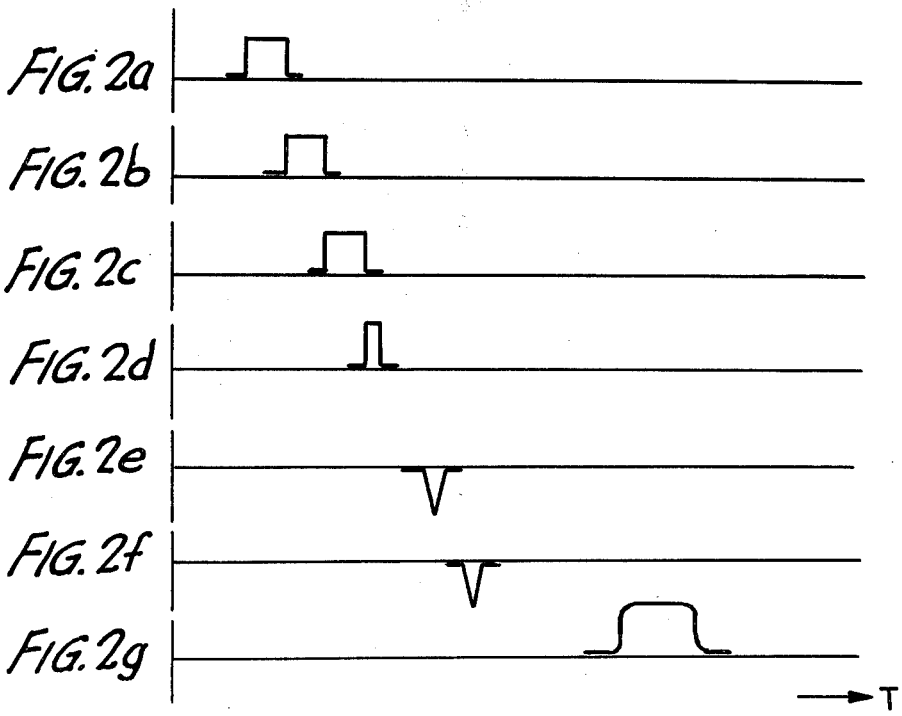

A system according to the present invention for determining the location of a cut, i.e. a single car or a plurality of cars, travelling along each of a plurality of storage tracks in a railway classification yard is schematically illustrated by the block diagram in FIG. 1. The cut that is taken under consideration is the most recent cut entering the particular storage track. By determining the location to the cut at a plurality of different times with set times intervals between each measurement, a plurality of velocity measurements for the cut can be calculated from this information.

While a railway classification yard often has 50 or more storage tracks, only three storage tracks, 3, 4 and 5 have been shown in FIG. 1 for simplicity. In a modern classification yard, the switches and retarders are typically controlled by a central processing unit 1, which automatically operates the switches and retarders for directing the cuts through the yards at appropriate speeds to the predesignated storage tracks. This type of automatically controlled classification yard is shown by U.S. Pat. No. 3,865,042 to DiPaola et al.

Such a classification yard generally includes both a master retarder located in the initial portion of the yard not far from the humping location and group retarders located in each of the tracks after the first set of switches. These retarders are utilized for controlling the speed of the cuts as they proceed through the yard. A major factor in controlling the speed of the cuts is the distance which the cuts have to travel prior to reaching their designated destinations. It is both necessary that the cuts reach the storage tracks to which they have been assigned and that when they reach that track they are travelling at sufficient speed so as to have enough momentum to couple with the last car previously placed on that storage track. On the other hand, if the speed of the cut is too great, then damage to the cars or the lading of the cars can result. It, therefore, is highly desirable to provide each cut with an appropriate exit speed from the retarders so that its actual coupling velocity comes as close as possible to the ideal coupling velocity. For this purpose, it is necessary to obtain accurate information about the location of the last car within the particular storage track and the coupling velocity of each car. With this information it is also possible to determine the dynamic characteristics of the cars moving along each of the storage tracks, i.e. the rollability of the cars on a particular storage track.

The rollability of the car along the storage track can vary due to a variety of different factors, some of which have been previously mentioned. By obtaining a plurality of velocity measurements, the acceleration and deceleration of the car at various points can be determined. While normally the car will be decelerating, if there is a dip in the track, a brief acceleration in the speed of the car can occur.

These dynamic measurements make it possible to determine the rollability of the car along the length of storage track prior to coupling. Since the available length of the storage track varies as more cars are fed into the track and since the rollability depends on the contour and condition of the actual track, the rolling characteristics for each car will be different.

In order to determine the rolling characteristics of the cars and the location of the last car in the track, central processing unit 1 activates signal generator 2 which provides an output pulse. FIG. 2(*a*) shows the pulse at point a in FIG. 1. This pulse is then applied to first rail 6 at point A of each of the storage tracks. While in the drawings, the lower rail of each track has been shown as being the first rail, in actuality it is immaterial which rail of the track is utilized as the first rail and which is used as the second rail.

The signal then travels along rail 6 until it reaches the last car 8 in track 4. The rear axle 9 and rear wheels 10*a* and 10*b* of car 8 electrically shunt rails 6 and 7 together. When the signal reaches the electrical shunt, it proceeds in three directions. First, the signal continues along rail 6 and it is also transferred to rail 7 through the shunt. The signal which is transferred to rail 7 continues in both directions along that rail, i.e., back towards the entrance point of track 4 and in the opposite direction along rail 7 towards its end point. The portion of the signal which travels along rail 7 back towards the entrance point can be considered to be a reflected signal and that signal at point D is coupled to multiplexer 11 at point E. The signal which was applied at point A is also applied to multiplexer 11 at point F.

Multiplexer 11, therefore, receives the signal applied to the first rail of each of the tracks and also receives the signal reflected back along the second rail of each of the tracks. Through the control of central processing unit 1, multiplexer 11 sequentially connects the signals from a particular track to be investigated to the subsequent portions of the measuring system. Thus, when a determination is to be made of the location of the last car on track 4, the signal from point E is coupled through to line G and the signal from point F is coupled through to line H. The signals at points c and b in FIG. 1 are shown in FIGS. 2(*b*) and 2(*c*), respectively.

The signals are then respectively applied to amplifiers 12*a* and 12*b*. The amplifiers serve to shape the signals and match the amplitude of the voltage of the signals. It is necessary to compensate for the voltages of the signals since it is recognized that attenuation of the signals will occur; such attenuation occurring for the same reason as in the impedance measuring systems. The signals then respectively pass through discriminators 13*a* and 13*b*, which create logic signals occurring the instant the outputs of the amplifiers depart from their quiescent points. Thus the signals which are utilized in making the measurement are purely based on the leading edges of the signals and not the steady state signals such as in the impedance measuring systems.

Delay generators 14*a* and 14*b* provide for timing adjustment and pulse shaping prior to supplying the signals to time-to-amplitude converter 15. The signal taken from point d after the discriminator 13*a* is an impulse as shown in FIG. 2(*d*). The signals at points e and f at the output of delay generators 14*a* and 14*b*, respectively, are impulses as shown in FIGS. 2(*e*) and 2(*f*), respectively. The signal from the output of delay generator 14*a*, which has been caused by the signal applied to the first rail of the track under investigation activates time-to-amplitude converter 15. This converter integrates a current until it is turned off by the output signal generated by delay generator 14*b*, which is caused by the signal reflected back along the second rail of the track under investigation. Thus, an output signal is applied at point g such as shown in FIG. 2(*g*).

The signal at the output of converter 15 has an amplitude which is proportional to the time delay between the signal applied to the first rail and the signal reflected back along the second rail of the selected track. The signal at point g is proportional to the distance x between the entrance point of the selected track and the rear wheels and axle of the last car in such track. The signal at point g is then applied to an analogue-to-digital converter 16 which provides a number in digital form proportional to the distance x, which signal is suitable for acceptance by the central processing unit. The entire measuring cycle can be accomplished in a matter of microseconds and at a maximum should take no more than approximately 50 microseconds. Thus, all of the storage tracks in a classification yard can be tested within at most a few seconds.

Due to the speed at which the measurements can be made, it is possible to determine the location of the car at a plurality of points of time as it moves along the storage track. By determining the distance traveled during a set time period, the velocity of the car is determined. These measurements of the velocity are fed back to the computer control, thereby making it possible to automatically tune the system so as to minimize the deviations in the coupling speeds.

While the velocity should be slowly decreasing, when the velocity rapidly drops to zero, it can be presumed that coupling has occurred. On the other hand, if the velocity slowly decreases to zero, it can be presumed that coupling never occurred but instead that the car has stalled. If such a stalling is detected, then it is possible to provide the subsequent car with a slightly greater speed so that its increased momentum can cause coupling of the stalled car with the other cars on the track. When the velocity does drop to zero, the distance measurement at that point in time is the distance to coupling. While all of these values are calculated by the computer, the necessary information for the computer is obtained by the system of the present invention.

It is noted that the above description and the accompanying drawings are provided merely to present an exemplary embodiment of the present invention and that additional modifications of that embodiment are possible within the scope of this invention without deviating from the spirit thereof.

I claim:

1. A system for measuring the velocity of a car moving along a railway track comprising:

means for determining the location of the car on the railway track including: pulse generating means capable of being coupled to a first rail of the track for transmitting a pulse signal along such rail, whereby such pulse signal travels along the first rail until it reaches the location of a railway car on the track where the rear wheels and axle of such car electrically couple the first rail and the second rail of the track; the pulse signal is then transferred from the first rail to the second rail back towards the point at which the pulse signal originated; pulse receiving means for receiving the pulse signal supplied to the first rail at the same time that such pulse signal is applied and also adapted to be coupled to the second rail at a point corresponding to the location at which the pulse generating means is coupled to the first rail so that said pulse receiving means receives the pulse signal back along the second rail; and, measuring the time delay between the application of the pulse signal to the first rail and the receipt of the pulse signal reflected back along the second rail and in response to such measurement providing an output signal indicative of the location of the wheels and the axle of the car that acted as the electrical shunt for the system for the first and second rails of the railway track, such indication being indicative of the location of the car on the railway track closest to the point at which the pulse signal is supplied to the first rail of the railway track; said means for determining the location of the car making at least two such measurements with a predetermined time interval between such measurement;

means for determining the distance traveled by the car during said time interval in response to the output signals received from the means for determining the location of the car; and, means for determining the velocity of the car based upon the distance traveled by the car during said time interval.

2. A system for determining the velocity of the most recent car entering and moving along each storage track of a railway classification yard having a plurality of storage tracks where the rear axle and wheels of such car electrically shunt the two rails of the respective storage track, the system comprising:

means for determining the location of the most recent car entering each storage track at least twice with a predetermined interval between each such measurement, such means including: signal supply means for supplying a pulse signal to the first rail of each of the storage tracks, such pulse being transmitted along the first rail until it reaches the shunt formed through the rear wheels and axle of the last car in the storage track, such pulse signal then being transferred through the shunt to the second rail of the storage track and transmitted along the second rail back towards the initiation point of the storage track, measuring means for measuring the time delay between application of the pulse signal to the first rail of one of the tracks and receipt of the pulse signal reflected back along the corresponding second rail of the same track and providing an output signal indicative of the location of the last car on the storage track selected by said track selecting means based upon such time delay; and, track selecting means for selectively coupling the pulse signal supply to the first rail of one of the tracks and the pulse signal reflected back along the corresponding second rail of the same track to said measuring means;

means for determining the distance traveled by the car during said time interval in response to the output of the means for determining the location of the car; and, means for determining the velocity of the car based upon the distance traveled by the car during said time interval.

3. A system as defined in claim 2 wherein: said pulse signal supply means provides a series of pulses to the first rail of each of the tracks; and said track selecting means includes multiplexing means for sequentially coupling to said measuring means the pulse signal supplied to the first rail of a selected track and the reflected pulse signals from the second rail of the same track.

4. A system for determining the location of a car on a railway track comprising:

pulse generating means capable of being coupled to a first rail of the track for transmitting a pulse signal along such rail, whereby such pulse signal travels along the first rail until it reaches the location of a railway car on the track where the rear wheels and axle of such car electrically couple the first rail and the second rail of the track, the pulse signal is then transferred from the first rail to the second rail and travels in the second rail back towards the point from which the pulse signal originated;

pulse receiving means for receiving the pulse signal supplied to the first rail at the same time that such pulse signal is applied and also adapted to be coupled to the second rail at a point corresponding to the location at which the pulse generating means is coupled to the first rail so that said pulse receiving means receives the pulse signal reflected back along the second rail; and, measuring means coupled to said pulse receiving means for measuring the time delay between receipt of the pulse signal supplied to the first rail and receipt of the pulse signal reflected back along the second rail and in response to such measurement providing an output signal indicative of the location of the wheels and axle of the car that acted as the electrical shunt for the system between the first and second rails of the railway track, such indication being indicative of the location of the car on the railway track closest to the point at which the pulse signal is supplied to the first rail of the railway track.

5. A system for determining the location of the last car in each storage track of a railway classification yard having a plurality of storage tracks where the rear axle and wheels of such cars electrically shunt the two rails of the storage track, the system comprising:

signal supply means for supplying a pulse signal to the first rail of each of the storage tracks, such pulse signal being transmitted along the first rail until it reaches the shunt formed through the rear wheels and axle of the last car in the storage track, such pulse signal then being transferred through the shunt to the second rail of the storage track and transmitted along the second rail back towards the initiation point of the storage track;

measuring means for measuring the time delay between application of the pulse signal to the first rail of one of the tracks and receipt of the pulse signal reflected back along the corresponding second rail of the same track and providing an output signal indicative of the location of the last car on the storage track selected by said track selecting means based upon such time delay; and, track selecting means for selectively coupling the pulse signal supplied to the first rail of one of the tracks and the pulse signal reflected back along the corresponding second rail of the same track to said measuring means.

6. A system as defined in claim 5 wherein: said pulse signal supply means provides a series of pulses to the first rail of each of the tracks; and said track selecting means includes multiplexing means for sequentially coupling to said measuring means the pulse signal supplied to the first rail of a selected track and the reflected pulse signals from the second rail of the same track.

7. In a railway classification yard having a plurality of storage tracks, each of the storage tracks having first and second rails, a system for determining the distance that the next car entering a particular storage track must travel before coupling with the last car that entered such track, such distance to coupling being determined by measuring the distance between the last car on each storage track and a location near the entrance of such storage track, the system comprising:

pulse signal generating means for supplying a pulse signal to the first rail of each of the storage tracks at a first location, such pulse signal being transmitted along the first rail until such pulse signal reaches the rear wheels and axle of the last car in each respective storage track which electrically shunt the first and second rails, the pulse signal then being transferred to the second rail through such shunt and the signal being transmitted in the second rail back towards the entrance of the respective storage track;

measuring means for measuring the time delay between the application of the pulse signal to the first rail of one of the tracks ad the receipt of the pulse signal reflected back along the corresponding second rail of the same track and said measuring means providing an output signal indicative of such time delay;

multiplexing means for selectively coupling said measuring means to the first and second rail of a selected track; and, indicating means coupled to receive the output signal of said measuring means and in response thereto providing a signal indicative of the location of the last car on the storage track selected by said multiplexing means.

8. A system for determining the velocity of the most recent car entering and moving along each storage track of a railway classification yard having a plurality of storage tracks where the rear axle and wheels of such car electrically shunt the two rails of the respective storage track, the system comprising:

means for determining the location of the most recent car entering each storage track at least twice with a predetermined interval between each such measurement, such means including: signal supply means for supplying a signal to the first rail of each of the storage tracks, such signal being transmitted along the first rail until it reaches the shunt formed through the rear wheels and axle of the last car in the storage track, such signal then being transferred through the shunt to the second rail of the storage track and transmitted along the second rail back towards the initiation point of the storage track, measuring means for measuring the time delay between application of the signal to the first rail of one of the tracks and receipt of the signal reflected back along the corresponding second rail of the same track and providing an output signal indicative of the location of the last car on the storage track selected by said track selecting means based upon such time delay; and, track selecting means for selectively coupling the signal supplied to the first rail of one of the tracks and the signal reflected back along the corresponding second rail of the same track to said measuring means;

said measuring means including: first signal generating means for generating a first impulse signal in response to the leading edge of the signal supplied to the first rail; second signal in response to the leading edge of the reflected signal received from the second rail; and comparator means for generating an output signal based upon the time between the first impulse signal and the second impulse signal;

means for determining the distance traveled by the car during said time interval in response to the output of the means for determining the location of the car; and, means for determining the velocity of the car based upon the distance traveled by the car during said time interval.

9. A system as defined in claim 8 wherein the output signal generated by said comparator means is an analogue signal and said measuring means further includes an analogue-to-digital convertor coupled to receive the output signal from said comparator means and in response thereto producing a digital output signal.

10. A system as defined in claim 9 further comprising a control means, said control means including means for initiating operation of said signal supply means and indicating means coupled to said converter means to receive the digital output signal and in response to such signal providing information about the location of the last car in each storage track.

11. A system for determining the location of the last car in each storage track of a railway classification yard having a plurality of storage tracks where the rear axle and wheels of such cars electrically shunt the two rails of the storage track, the system comprising;

signal supply means for supplying a series of signals to the first rail of each of the storage tracks, such signal being transmitted along the first rail until it reaches the shunt formed through the rear wheels and axle of the last car in the storage track, such signal then being transferred through the shunt to the second rail of the storage track and transmitted along the second rail back towards the initiation point of the storage track;

measuring means for measuring the time delay between application of the signal to the first rail of one of the tracks and receipt of the signal reflected back along the corresponding second rail of the same track and providing an output signal indicative of the location of the last car on the storage track selected by said track selecting means based upon such time delay;

said measuring means including first signal generating means for generating a first impulse signal in response to the leading edge of the signal supplied to the first rail; second signal generating means for generating a second impulse signal in response to the leading edge of the reflected signal received from the second rail; and comparator means for generating an output signal based upon the time between the first impulse signal and the second impulse signal; and, track selecting means including multiplexing means for sequentially coupling to said measuring means the signal supplied to the first rail of a selected track and the reflected signals from the second rail of the same track.

12. A system as defined in claim 11 wherein the output signal generated by said comparator means is an analogue signal and said measuring means further includes an analogue-to-digital converter coupled to receive the output signal from said comparator means and in response thereto producing a digital output signal.

13. A system as defined in claim 12 further comprising a control means, said control means including means for initiating operation of said signal supply means and indicating means coupled to said converter means to receive the digital output signal and in response to such signal providing information about the location of the last car in each storage track.

* * * * *